United States Patent [19]

McCormick

[11] Patent Number: 4,686,800

[45] Date of Patent: Aug. 18, 1987

[54] GEOMETRIC CONSTRUCTION SYSTEM AND METHOD

[76] Inventor: Donald M. McCormick, 3311C N. O'Henry Blvd., Greensboro, N.C. 27405

[21] Appl. No.: 823,701

[22] Filed: Jan. 29, 1986

[51] Int. Cl.[4] ..... E04B 1/32

[52] U.S. Cl. ..... 52/81; 29/526 R; 52/DIG. 10; 52/648

[58] Field of Search ..... 29/526 R, 155 R; 52/DIG. 10, 81, 109, 648; 403/170, 171, 176, 206, 217

[56] References Cited

U.S. PATENT DOCUMENTS

| | | | |
|---|---|---|---|
| 2,986,241 | 5/1961 | Fuller | 52/DIG. 10 |
| 3,662,486 | 5/1972 | Freedman | 52/DIG. 10 |
| 3,987,580 | 10/1976 | Ausnit | 52/DIG. 10 |
| 4,107,870 | 8/1978 | Ausnit | 52/DIG. 10 |
| 4,271,645 | 6/1981 | Crooks | 52/DIG. 10 |
| 4,571,114 | 2/1986 | Rionda | 403/405.1 |

FOREIGN PATENT DOCUMENTS

| | | | |
|---|---|---|---|
| 469958 | 12/1973 | Australia | 52/DIG. 10 |
| 772048 | 8/1943 | France | 52/DIG. 10 |

OTHER PUBLICATIONS

Philosophical Transactions of the Royal Society, May 13, 1954, Uniform Polyhedra, p. 439 and Plates 1–6.

*Primary Examiner*—Henry E. Raduazo

*Attorney, Agent, or Firm*—Griffin, Branigan, & Butler

[57] ABSTRACT

A cellular frame is generated to represent a solid geometric tetrahedron. The cellular frame comprises four sets of struts, each set of struts including three struts (46 or 46') which represent a planar face of the tetrahedron. Each strut is connected at a vertex to a strut in a neighboring face of the represented tetrahedron. A plurality of cellular frames can be oriented and connected together with each cellular frame sharing at least one vertex with another cellular frame. The connection of cellular frames results in the representation of exterior and/or interior geometrical structures by various struts included in one or more cellular frames.

23 Claims, 42 Drawing Figures

FIG. 8A
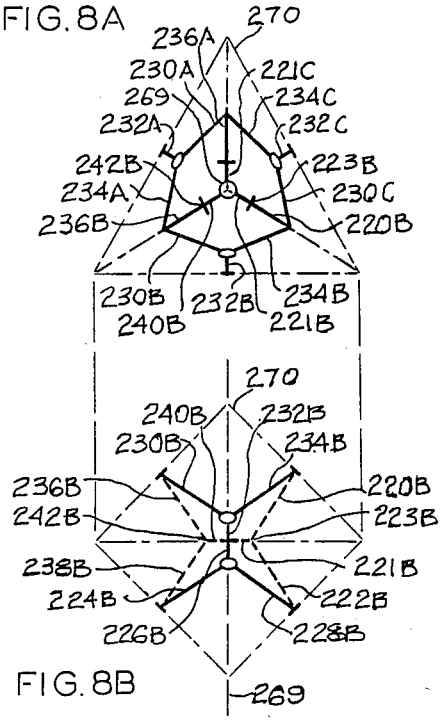
FIG. 8B
FIG. 9A
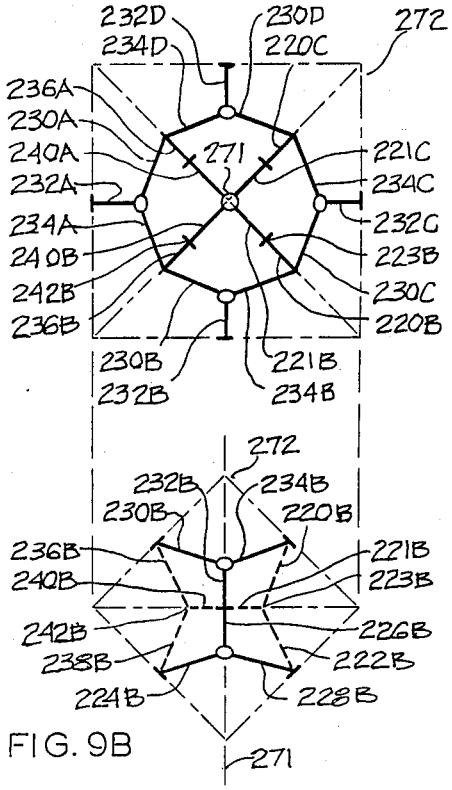
FIG. 9B
FIG. 10A
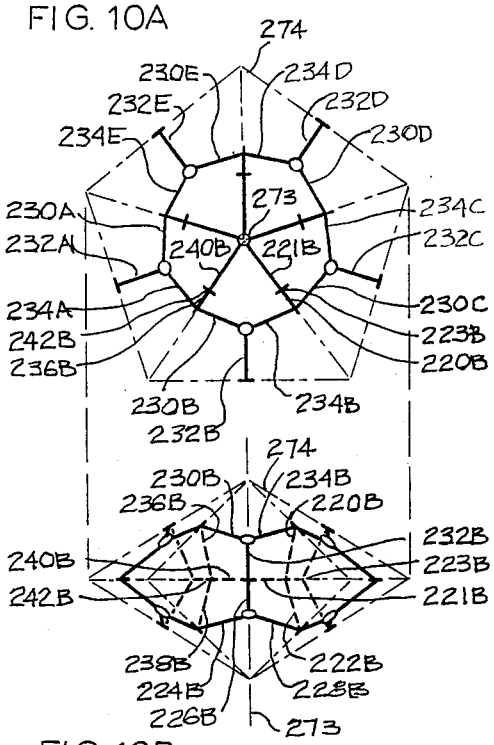
FIG. 10B
FIG. 11A
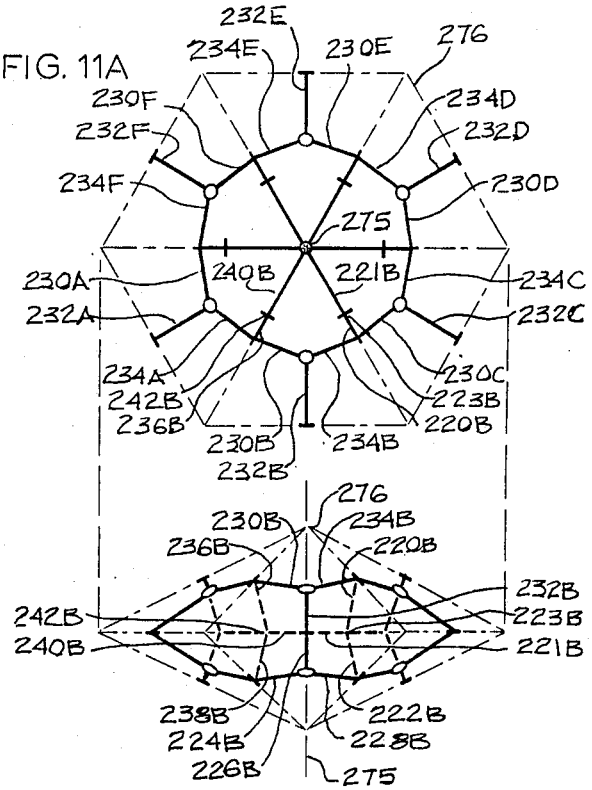
FIG. 11B

GEOMETRIC CONSTRUCTION SYSTEM AND METHOD

BACKGROUND OF THE INVENTION

I. Field of the Invention

This invention relates to methods and apparatus for assembling geometrical structures.

II. Prior Art and Other Considerations

Over the years the study of solid geometry has given birth to significant developments in numerous application fields. Such fields include the construction of permanent and temporary buildings or shelters; antenna structure; aircraft, spacecraft, and watercraft frame design; and, mathematical and scientific models and toys. It is an object of this invention to provide a novel geometrical construction system and method which is useful in such fields.

SUMMARY

A cellular frame is generated to represent a solid geometric tetrahedron. The cellular frame comprises four sets of struts, each set of struts including three struts which represent a planar face of the tetrahedron. Each strut is connected at a vertex to a strut in a neighboring face of the represented tetrahedral. A plurality of cellular frames can be oriented and connected together with each cellular frame sharing at least one vertex with another cellular frame. The connection of cellular frames results in the representation of exterior and/or interior geometrical structures by various struts included in one or more cellular frames.

A planar face or planar polygon is said to be represented by a plurality of struts associated therewith when the struts either (1) form the perimeter of the planar polygon, or (2) have at least their first ends connected to another strut at an interior point in the plane of the polygon and have second ends either (a) connected to another strut in the plane of the polygon or (b) perpendicularly bisecting and terminating at respective perimeter sides of the polygon.

The types of solid geometric tetrahedrons representable by cellular frames include pyramid-type tetrahedrons, double wedge-type tetrahedrons, and equilateral-type tetrahedrons. Cellular frames representing a plurality of essentially identical solid geometric tetrahedrons can be oriented and connected together in a manner whereby the solid geometric tetrahedrons are envisioned as being oriented either in face-to-face relationship or in edge-to-edge relationship.

Cellular frames representing Double Wedge-type tetrahedrons can be oriented and connected about a common edge of a tetrahedron to form a cluster having the common edge as a major axis. Clusters can be used to replace appropriate planar faces of imaginary polyhedrons with the major axis of the cluster being perpendicular to the plane of the replaced face. Depending upon the characteristics of the particular double wedge-type tetrahedron represented by the cellular frames comprising the cluster, struts from a plurality of cellular frames may represent a regular interior polyhedral structure whose center is located at the center of the imaginary polyhedron (i.e. the polyhedron whose faces were replaced by clusters). In certain situations wherein struts from a plurality of cellular frames do not represent a complete such interior polyhedral structure, supplemental struts or bridging struts can be added to complete a regular interior geometrical structure. When clusters are used to replace appropriate planar faces of imaginary polyhedrons, further clusters known as orthogonal clusters can be formed about an axis which is colinear with the edge formed by the intersection of two neighboring planar faces of the imaginary polyhedron.

Exterior and interior geometrical structures formed by the orientation and connection of a plurality of cellular frames can be used as reference structures from which representations of other geometrical structures can be evolved. In this respect, struts can be added to the exterior or interior geometrical structure by connecting the struts either to radiate toward or to radiate away from the center of the geometrical structure. Cellular frames can be added to various exterior or interior geometrical structures to form corollary structures. The addition of further cellular frames to the corollary structures results in the repetition of the exterior or interior geometrical structure which gave birth to the corollary structure. Moreover, a plurality of exterior geometrical structures can be connected together about a central geometric structure to form a compound geometric structure. Supplemental struts or even cellular frames can be added in some instances to compound geometric structures to complete a polyhedral assembly (or framework).

The polyhedral structures produced by the steps of the invention provide modular frames which do not have awkward corners such as those which would otherwise occur at the non-planar intersection of three planar faces of the represented solid geometric polyhedrals. Modular construction of both permanent and temporary structures or craft is faciliated by the ability to add or delete struts or cellular frames in directions either toward or away from the center of the geometric structure. Rigid or flexible walls can be connected between struts to form cellular compartments. The ability to add and delete struts and/or cellular frames and the wall-forming material provides the ability to add or delete cellular compartments without affecting basic structural integrity. Accordingly, utilization of the method of the invention has application in the design, development, and construction of both earth-based structures (whether temporary, i.e. tents, etc., or permanent) and outer space structures (such as space stations). The connection of struts according to the invention also provides an instructional aid for the understanding of geometrical models, as well as a means of entertainment and recreation.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

FIGS. 8A and 8B are plan and elevation views, respectively, of struts included in a cluster comprising three cellular frames constructed and connected together in a manner to represent an orientation of three Case 1 Double Wedges;

FIGS. 9A and 9B are plan and elevation views, respectively, of struts included in a cluster comprising four cellular frames constructed and connected together in a manner to represent an orientation of four Case 2 Double Wedges;

FIGS. 10A and 10B are plan and elevation views, respectively, of struts included in a cluster comprising five cellular frames constructed and connected together in a manner to represent an orientation of five Case 3 Double Wedges;

FIGS. 11A and 11B are plan and elevation views, respectively, of struts included in a cluster comprising six cellular frames constructed and connected together in a manner to represent an orientation of six Case 4 Double Wedges;

FIGS. 13B(1) and 13B(2) are front and plan views, respectively, of various struts included in cellular frames representing Case 3 Double Wedges constructed and connected together in a manner whereby each face of an imaginary solid geometric pentagonal-faced dodecahedron is replaced by a cluster of cellular frames, and wherein spaces occur in the interior of the dodecahedron;

FIG. 14A(1) is a perspective view showing how struts included in four cellular frames, each cellular frame representing an imaginary solid geometric equilateral-type tetrahedron, can be oriented and connected together edge to edge;

FIG. 14A(2) is a perspective view showing struts representing a solid geometric octahedron, the illustrated struts including struts included in four additional cellular frames connected edge-to-edge in a first manner to the tetrahedron represented by the cellular frames shown in FIG. 14A(1);

DETAILED DESCRIPTION OF THE DRAWINGS

Figure 1A:
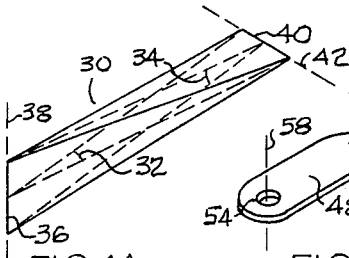
FIG. 1A is a perspective view of a solid geometric tetrahedron.

FIG. 1A shows a solid geometric tetrahedron 30 having dihedral angles 32 and 34. Dihedral angle 32 is formed with its vertex at an edge 36 which lies along axis 38; dihedral angle 34 is formed with its vertex at an edge 40 which lies along an axis 42. The axes 38 and 42 are orthogonal to one another.

Figure 1B:
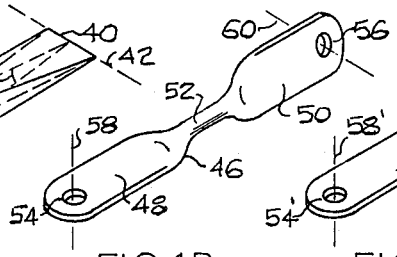
FIG. 1B is a perspective view of a strut according to a first embodiment of the invention.

FIG. 1B shows a strut 46 according to a first embodiment of the invention. Strut 46 comprises a flatened horizontally-oriented portion 48 and a flatened vertically-oriented portion 50. Portions 48 and 50 are connected by an intermediate portion 52 which, in one embodiment, is essentially cylindrical. An aperture 54 is provided in flat portion 48 near a first end of strut 46 and an aperture 56 is provided in flat portion 50 near the other end of strut 46. The center of aperture 54 lies on an axis 58; the center of aperture 56 lies on an axis 60. Axes 58 and 60 have the same orthogonal relationship to one another as do axes 38 and 42 of the tetrahedron in FIG. 1A.

Figure 1C:
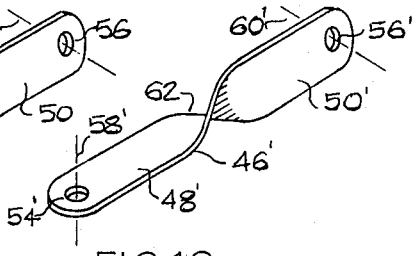
FIG. 1C is a perspective view of a strut according to a second embodiment of the invention.

FIG. 1C shows a strut 46' according to another embodiment of the invention. Strut 46' comprises flat portions 48' and 50' and apertures 54' and 56' having centers lying on respective axes 58' and 60', all similarly positioned and oriented as the members indicated by correspondingly numbered but unprimed reference numerals of the embodiment of FIG. 1B. At intermediate portion 62, strut 46' is essentially twisted through a 90 degree rotation.

Figure 2:
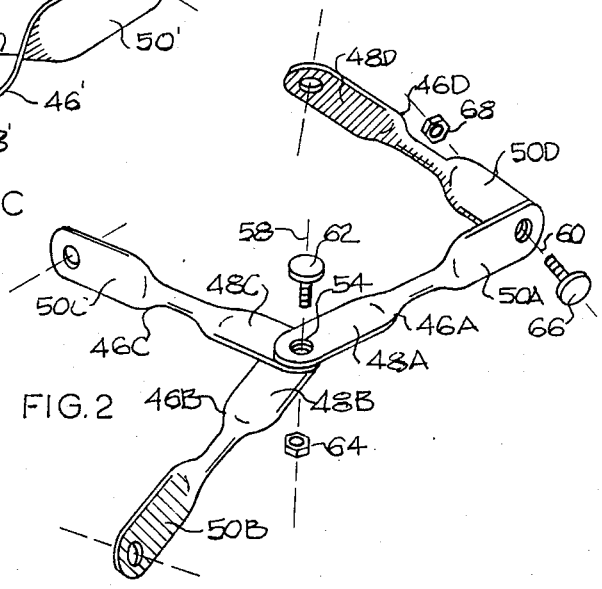
FIG. 2 is a perspective view showing a plurality of struts connected together according to an embodiment of the invention.

As shown and described the struts 46 and 46' are understood to be tetrahedral in nature by virtue of the fact that one end thereof is formed to be connectable (to another strut) along an axis which is perpendicular to the axis of connection at the other end of the strut. In this respect, FIG. 2 shows a manner in which four struts 46A, 46B, 46C, and 46D can be connected. In particular, flat portions 48A, 48B, and 48C are connected with their apertures 54 aligned along axis 58 so that fastener means (i.e., threaded bolt 62 and nut 64) can connect struts 46A, 46B, and 46C in a manner whereby portions 48A, 48B, and 48C neighbor one another and lie in parallel planes. Portions 50A and 50D of struts 46A, 46D, respectively, are connectable along axis 60 by fastener means (threaded bolt 66 and nut 68) when portions 50A, 50D lie in neighboring, parallel planes. Thus, portion 48A of strut 46A is connectable to other struts about an axis 58 which is orthogonal to the axis 60 about which portion 50A is connectable. It should be understood that tetrahedral struts of various sizes and dimensions can be formed. Likewise, other types of fastener means can be used to connect struts.

A plurality of tetrahedral struts, such as the strut 46 of FIG. 1B or the strut 46' of FIG. 1C for examples are connectable together in a manner such as that understood from FIG. 2 to represent imaginary planar polygonal faces of an imaginary solid geometric tetrahedron and are further connectable to form a cellular frame which represents the imaginary solid geometric tetrahedron. For descriptive purposes a planar polygon or planar face is said herein to be represented by a plurality of struts associated therewith when the struts either (1) form the perimeter of the planar polygon, or (2) have at least their first ends connected to another strut at an interior point in the plane of the polygon and have second ends either (a) connected to another strut in the plane of the polygon or (b) perpendicularly bisecting and terminating at respective perimeter sides of the polygon. As used herein, the term "bisect" does not necessarily mean that the bisected side of the polygon is divided into two parts of equal length, but that the side is divided into two lengths.

Figure 3A:
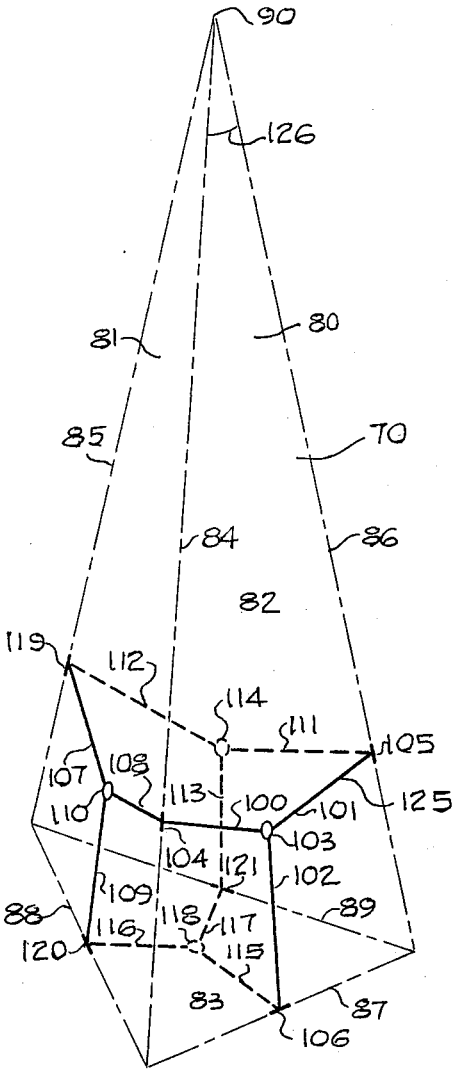
FIG. 3A is a perspective view of a plurality of struts connected to form a cellular frame and to represent an imaginary solid geometric pyramid-type tetrahedron.
Figure 3B:
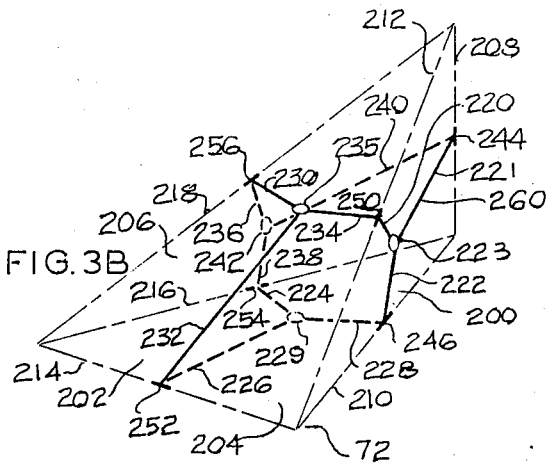
FIG. 3B is a perspective view of a plurality of struts connected to form a cellular frame and to represent an imaginary solid geometric double wedge-type tetrahedron.
Figure 3C:
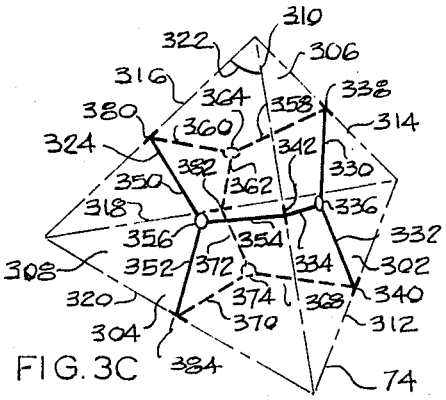
FIG. 3C is a perspective view of a plurality of struts connected to form a cellular frame and to represent an imaginary solid geometric equilateral-type tetrahedron.

Imaginary solid geometric tetrahedrons representable by such cellular frames include those depicted by the alternating long and short broken lines of FIGS. 3A, 3B, and 3C. In this regard, an imaginary solid geometric pyramid-type tetrahedron 70 is represented in FIG. 3A; an imaginary solid geometric double wedge-type tetrahedron 72 is represented in FIG. 3B; and, an imaginary solid geometric equilateral-type tetrahedron 74 is represented in FIG. 3C. Each represented tetrahedron type and the manner by which it is represented by a plurality of connected-together struts is hereinafter described. Once it is seen how a tetrahedral type is represented by a cellular frame of struts, it will further be described how a plurality of such cellular frames can be connected together in various manners to generate geometrical structures.

PYRAMID-TYPE TETRAHEDRAL REPRESENTATION

The imaginary solid geometric pyramid-type tetrahedral 70 illustrated in FIG. 3A has imaginary planar faces 80, 81, and 82 (face 82 being hidden from the viewer in FIG. 3A) and an imaginary planar base 83. Faces 80 and 81 meet to form a dihedral angle at edge 84; faces 81 and 82 meet to form a dihedral angle at edge 85; faces 82 and 80 meet to form a dihedral angle at edge 86. Face 80 and base 83 meet to form a dihedral angle at edge 87; face 81 and base 83 meet to form a dihedral angle at edge 88; face 82 and base 83 meet to form a dihedral angle at edge 89. Faces 80, 81, and 82 meet at apex 90.

The imaginary solid geometric pyramid-type tetrahedral 70 is represented in FIG. 3A by a cellular frame of connected-together struts (such as struts 46 or struts 46'). In generating the cellular frame, the struts are used to represent each imaginary planar face 80, 81, and 82 and the imaginary planar base 83. In this respect, struts 100, 101, and 102 represent imaginary planar face 80. Struts 100, 101, and 102 each have their first ends connected together at an interior point 103 of the planar face 80. The manner of the connection is understood, for example, with reference to similarly connected-together struts 46A, 46B, and 46C along axis 58 as shown in FIG. 2. The second or opposite ends of the struts 100, 101, and 102 are positioned to define intermediate points along the respective edges 84, 86, and 87 of the imaginary solid geometric pyramid. In this regard the second end of strut 100 terminates at a point 104 which lies at an intermediate location along imaginary edge 84; the second end of strut 101 terminates at a point 105 which lies at an intermediate location along imaginary edge 86; and, the second end of strut 102 terminates at a point 106 which lies at an intermediate location along imaginary edge 87. Struts 100, 101, and 102 are perpendicular to respective edges 84, 86, and 87; struts 107, 108, and 109 are perpendicular to respective edges 85, 84, and 88; and struts 111, 112, and 113 are perpendicular to respective edges 86, 85, and 89.

The other imaginary planar faces 81 and 82 and the imaginary planar base are represented in similar manner. In this respect, FIG. 3A shows struts 107, 108, and 109 with first ends thereof connected together at point 110 to represent face 81; struts 111, 112, and 113 with first ends thereof connected together at point 114 to represent face 82; and, struts 115, 116, and 117 with first ends thereof connected together at point 118 to represent base 83.

The second ends of the struts used to represent an imaginary planar face are positioned not only to form an imaginary edge of the imaginary tetrahedron, but also to be connectable at the imaginary edge to a second end of a strut representing a neighboring face, thereby forming a vertex and dihedral angle of the cellular frame. For example, the second end of strut 100 connects to the second end of strut 108 at vertex 104 lying on imaginary edge 84. In like manner, struts 101 and 111 will connect at vertex 105; struts 102 and 115 connect at vertex 106; struts 107 and 112 connect at vertex 119; struts 109 and 116 connect at vertex 120; and, struts 113 and 117 connect at vertex 121.

In the above-described manner the struts 100–102, 107–109, 111–113, and 115–117 are connected together to form a cellular frame 125 which represents or corresponds to an imaginary solid geometric pyramid-type tetrahedron 70 which the cellular frame 125 is said to represent. It will be appreciated that a represented imaginary solid geometric pyramid-type tetrahedron such as tetrahedron 70 has characteristics (such as the magnitude of face angles and dihedral angles) which depend upon factors such as the lengths of various struts utilized in the generation of the cellular frame. Numerous pyramid-type tetrahedrons can accordingly be represented. Three examples are provided below and are referenced herein as Pyramid Case 1; Pyramid Case 2; and Pyramid Case 3. It should be understood that many other cases of pyramid-type tetrahedrons are envisioned.

According to Pyramid Case 1, the face angles at apex 90 of pyramid 70 (e.g. face angle 126) are approximately 61° and the dihedral angles formed by edges 84, 85, and 86 (or connections 104, 105, and 119) are each on the order of 72°. An example of a geometric structural configuration resulting from the connection of a plurality of Case 1 pyramids is provided hereinafter with reference to FIGS. 4A and 4B.

According to Pyramid Case 2, the face angles at apex 90 of pyramid 70 (e.g. face angle 126) are approximately 90° and the dihedral angles formed by edges 84, 85 and 86 (or connections 104, 105, and 119) are each on the order of 90°. An example of a geometric structural configuration resulting from the connection of a plurality of Case 2 pyramids is provided hereinafter with reference to FIGS. 5A and 5B.

According to Pyramid Case 3, the face angles at apex 90 of pyramid 70 (e.g. face angle 126) are approximately 36° and the dihedral angles formed by edges 84, 85, and 86 (or connections 104, 105, and 119) are each on the order of 65°. An example of a geometric structural configuration resulting from the connection of a plurality of Case 3 pyramids is provided hereinafter with reference to FIGS. 6A and 6B.

It will now be seen that a plurality of cellular frames 125 can be generated and connected to one another in a manner to generate geometrical structures. In this regard, it will be seen that when a plurality of essentially identical cellular frame-represented imaginary solid geometric tetrahedrons envisioned as being oriented either in face-to-face relationship or in edge-to-edge relationship, the cellular frames yield further geometrical structures. In the ensuing discussion, it will be understood that a first cellular frame (generated in the above-described manner) is depicted by struts having the reference numerals 100A–102A, 107A–109A, 111A–113A, and 115A–117A as described above; a second similarly-generated cellular frame is depicted by struts having reference numerals 100B–102B, 107B–109B, 111B–113B and 115B–117B; a third similarly-generated cellular frame is depicted by struts having reference numerals 100C–102C, 107C–109C, 111C–113C, and 115C–117C; and so forth.

Figure 4A:
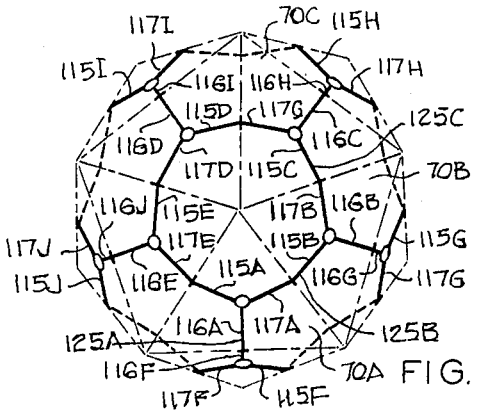
FIG. 4A is a front view of various struts included in twenty cellular frames constructed and connected together in a manner to represent a face-to-face orientation of twenty solid geometric Case 1 Pyramids.
Figure 4B:
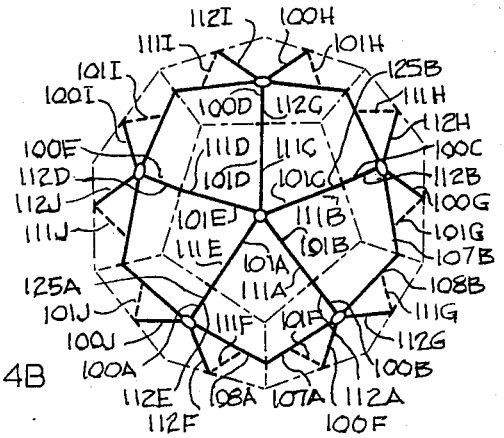
FIG. 4B is a front view of various other struts included in the twenty cellular frames constructed and connected together in a manner to represent the face-to-face orientation of twenty solid geometric Case 1 Pyramids.

In the above regard, FIGS. 4A and 4B are front views showing selected struts when cellular frames representing twenty solid geometry Case 1 pyramids are connected together in a manner to represent the face-to-face orientation of twenty such represented pyramids. Struts not shown in FIGS. 4A and 4B are struts 102, 109, and 113 of FIG. 3A. The exterior solid geometrical structure formed by the connections is shown in FIG. 4A as representing an icosahedron.

FIG. 4A shows a front view of the geometric structural configuration generated by the struts utilized to represent the bases 83, 83A, 83B, etc. of the twenty face-to-face connected Case 1 pyramids. Thus, the struts shown in FIG. 4A form an exterior geometrical structure which represents a triangularly-faced icosahedron. In particular struts 115A, 116A, 117A; 115B, 116B, 117B; 115C, 116C, 117C; etc. are shown in FIG. 4A wherein a first set of struts consisting of struts 115A, 116A, 117A represent a first triangular face of the icosahedron. In like manner struts 115B, 116B, and 117B represent a second triangular face, struts 115C, 116C, and 117C represent a third triangular face, and so forth.

The connections of the Case 1 pyramids are said to be face-to-face inasmuch as imaginary planar face 82A of a first pyramid 70A is conceptualized as abutting and being coextensive with an imaginary planar face 80B of a second pyramid 70B; and imaginary planar face 82B of the second pyramid 70B is similarly conceptualized with respect to imaginary planar face 80C of a third pyramid 70C; and so forth. In view of the face-to-face relationship, the cellular frame representing an imaginary pyramid shares at least one common vertex with a cellular frame representing a neighboring pyramid. For example, cellular frame 125A representing pyramid 70A shares three common vertices with the cellular frame 125B representing pyramid 70B. In accordance with the nomenclature of cellular frame 125A, cellular frame 125A views the shared vertices as being vertices 114A, 105A, 119A, and 121A. In accordance with its nomenclature, cellular frame 125B views these same shared vertices as being vertices 114B, 119B, 105B, and 121B, respectively. Thus it is seen that in accordance with a mode of the invention the cellular frame 125B can be formed by merely adding struts to the cellular frame 125A in a manner whereby struts 111A, 112A, and 113A serve as struts 101B, 100B, and 102B, respectively, of cellular frame 125B.

FIG. 4B shows various struts which occur in the interior of the icosahedral structure formed by the face-to-face connection by twenty Case 1 pyramids. In this respect, it should be understood that FIG. 4B is not to scale with respect to FIG. 4A. With respect to cellular frame 125A, struts 101A, 100A, 108A, 107A, 112A, and 111A are shown in FIG. 4B, with similar struts of various other cellular frames 125B, 125C, etc. also being shown. FIG. 4B shows that a second set of struts, particularly struts 101A (alias 111E), 101B (alias 111A), 101C (alias 111B), 101D (alias 111C), 101E (alias 111D), lie in the same plane and have first ends thereof connected to a common point. The second ends of the struts 101A, 101B, 101C, 101D, and 101E lie along and bisect the sides of a represented imaginary planar pentagon. Moreover, from FIG. 4B it is understood that a series of twelve similarly-represented planar pentagons are formed by the struts shown in FIG. 4B, with the solid geometric structure represented by such struts being a pentagonal-faced dodecahedron.

From the foregoing it is seen that the twenty Pyramid Case 1-representing cellular frames 125 constructed in a manner to represent the face-to-face orientation of twenty imaginary Case 1 pyramids results in a geometrical structure having both an external geometric frame and an internal geometric frame. In this respect, various co-planar struts of cellular frames represent triangular faces of an exterior icosahedron and various other co-planar struts of cellular frames represent pentagonal faces of an interior pentagonal-faced dodecahedron.

The manner of connecting a plurality of cellular frames, such as is illustrated in FIGS. 4A and 4B, is understood with reference to FIG. 2. In this respect, if struts 46A, 46B, and 46C of FIG. 2 are seen as corresponding to struts 115A, 116A, and 117A of cellular frame 125, then strut 46D of FIG. 2 corresponds to strut 117E of cellular frame 125E. Thus, struts 115A and 117E (as well as strut 102A) lie in a plane which is orthogonal to the plane in which struts 115A, 116A, and 117A lie. It is understood that struts 100A (alias 111E), 101A (alias 112E) and 102A (alias 113E) are shared by the two cellular frames 125A and 125E. Moreover, although unillustrated, it is understood that struts 100A and 111E are connected in analogous fashion to struts 115A and 117E, and struts 101A and 112E are connected in analogous fashion to struts 115A and 117E. Thus, the connection of struts included in adjacent cellular frames representing any solid geometric structure described herein is understood from FIG. 2.

Figure 5A:
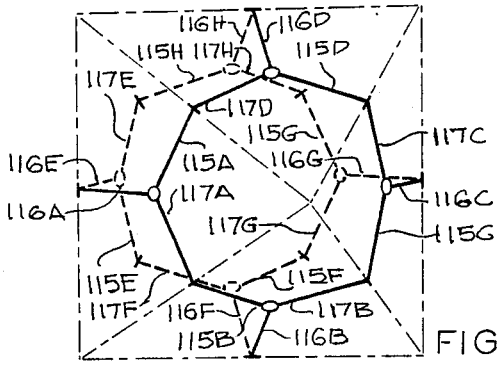
FIG. 5A is a partial front perspective view of various struts included in eight cellular frames constructed and connected together in a manner to represent a face-to-face orientation of eight solid geometric Case 2 Pyramids.
Figure 5B:
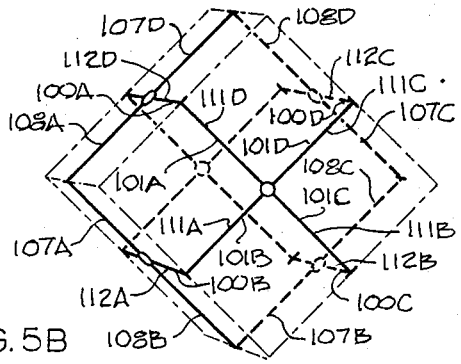
FIG. 5B is a partial front perspective view of various other struts included in the eight cellular frames constructed and connected together in the manner to represent the face-to-face orientation of eight solid geometric Case 2 Pyramids.

FIGS. 5A and 5B partially illustrate geometrical structures which result when eight Case 2 pyramids are oriented in face-to-face relationship. The exterior structure formed by the cellular frames representing the eight thusly-connected Case 2 pyramids is shown in FIG. 5A. The interior structure formed by the cellular frames representing the eight thusly-connected Case 2 pyramids is shown in FIG. 5B in which struts of neighboring cellular frames lie in planes and represent the faces of a cube. For example, the struts in a second set of struts consisting of struts 101A (alias 111D), 101B (alias 111A), 101C (alias 111B), and 101D (alias 111C) are co-planar and represent the square face of an imaginary solid geometric cube.

Figure 6A:
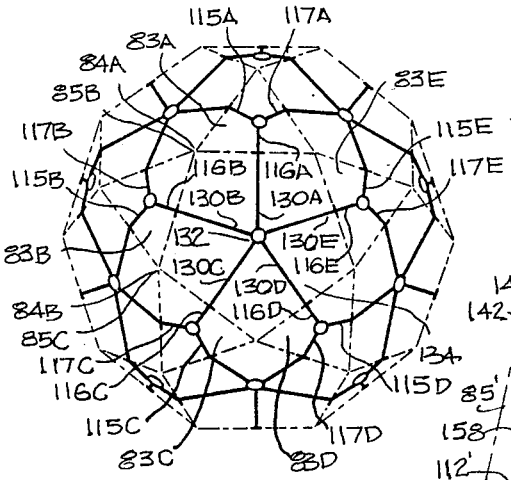
FIG. 6A is a front view of various struts included in twenty cellular frames constructed and connected together in a manner to represent the edge-to-edge orientation of twenty solid geometric Case 3 Pyramids.
Figure 6B:
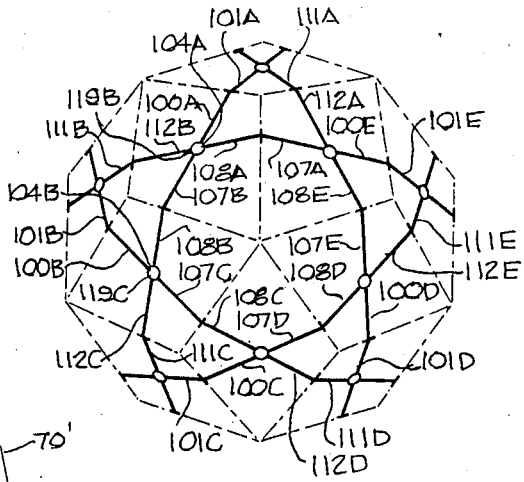
FIG. 6B is a front view of various other struts included in the twenty cellular frames constructed and connected together in a manner to represent the edge-to-edge orientation of twenty solid geometric Case 3 Pyramids.

FIGS. 6A and 6B partially illustrate geometrical structures which result when twenty Case 3 pyramids are oriented edge-to-edge. The orientations of the Case 3 pyramids are said to be edge-to-edge inasmuch as each edge 84, 85, and 86 of an imaginary pyramid is conceptualized as abutting and being coextensive with one such edge of another imaginary pyramid. The bases 83A, 83B, etc. including struts 115, 116, and 117 of various imaginary pyramids are shown in FIG. 6A. When joined edge-to-edge in this manner, it is understood that at least one vertex of a first cellular frame also serves as a vertex for a second cellular frame. For example, as seen in FIG. 6B vertex 104A occuring on edge 84B of cellular frame 125A also serves as vertex 119B occurring on edge 85B of cellular frame 125B. Likewise, vertex 104B occurring on edge 84B of cellular frame 125B also serves as vertex 119C occurring on edge 85C of cellular frame 125C.

The interior structure formed by the cellular frames representing the twenty Case 3 pyramids formed edge-to-edge in the above-described manner is shown in FIG. 6B wherein various struts of neighboring cellular frames are co-planar in a manner to represent a rhomboid. For example, a set of struts consisting of struts 100A, 108A, 107B and 112B are co-planar and represent a first of thirty rhomboidal-shaped faces of a polyhedron. Struts 100B, 108B, 107C, and 112C similarly are co-planar and represent a second such face, and so forth. Alternately, the interior structure shown in FIG. 6B can be viewed as a series of six interconnected decagonal meridians.

With respect to the exterior geometrical structure depicted by FIG. 6A, a plurality of triangular faces are represented by planar struts. In this regard, a first triangular face is represented by a set of struts consisting of struts 115A, 116A, and 117A; a second triangular face is represented by a set of struts consisting of struts 115B, 116B, and 117B; and so forth. FIG. 6A also shows that supplemental connective struts such as struts 130A, 130B, 130C, 130D, and 130E have been connected to first ends of respective struts 116A, 116B, 116C, 116D, and 116E. The other ends of struts 130A–130E are connected together at a point 132. Thusly connected together, a pentagonal face 134 of the exterior geometrical structure is completed and said to be represented by the added connective struts.

TRUNCATED PYRAMID-TYPE TETRAHEDRON REPRESENTATION

Figure 7:
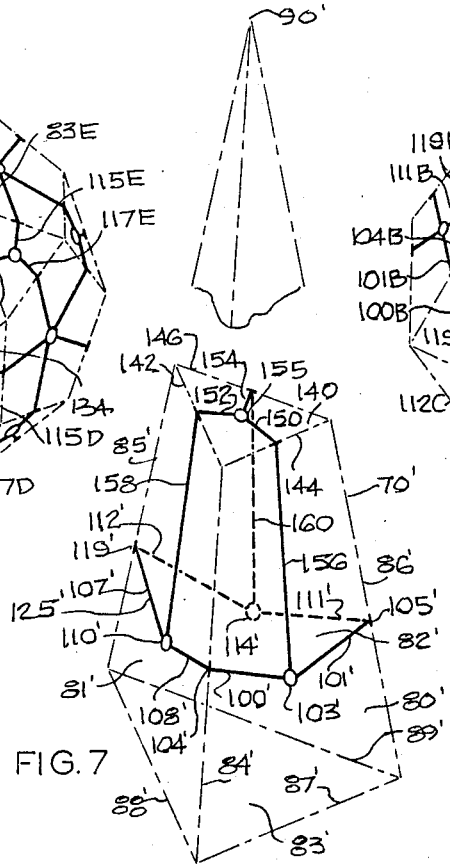
FIG. 7 is a perspective view of a plurality of struts connected to form a cellular frame and to represent an imaginary solid geometric truncated pyramid-type tetrahedron.

The imaginary solid geometric truncated pyramid-type tetrahedron 70′ illustrated in FIG. 7 has imaginary planar faces 80′, 81′, and 82′; base 83′; and edges 84′, 85′, 86′, 87′, 88′, and 89′. In addition, the illustrated truncated tetrahedron has an imaginary truncated planar face 140 formed by the intersection of the pyramid-type tetrahedron and a truncation plane. The truncated planar face has three imaginary sides or edge 142, 144, and 146.

The imaginary solid geometric truncated pyramid-type tetrahedron 70′ of FIG. 7 is represented by a cellular frame 125′ the construction of which is understood with some reference to the cellular frame 125 of FIG. 3A. In this respect, the arrangement of struts 100′, 101′, 107′, 108′, 112′, and 111′ is understood with reference to the corresponding struts of FIG. 3A designated by like-numbered but unprimed reference numerals. Struts 150, 152, and 154 are connected to represent the truncated planar face 140. First ends of struts 150, 152, and 154 are connected together at interior point 155. Second ends of the struts 150, 152, and 154 are positioned to define intermediate points along the respective imaginary edges 144, 142, and 146 of the truncated planar face 140. Strut 156 lying in the plane of face 80' has its first end connected to interior point 103' and its second end connected to the second end of strut 150. Strut 158 lying in the plane of face 81' has its first end connected to interior point 110' and its second end connected to the second end of strut 152. Strut 160 lying in the plane of face 82' has its first end connected to interior point 114' and its second end connected to the second end of strut 154.

It has been described above how cellular frames 125 can be connected together in a manner to reflect either the face-to-face or the edge-to-edge orientation of a plurality of imaginary pyramid-type tetrahedrons represented by the cellular frames 125, and that exterior and interior geometrical structures result from such connection of cellular frames 125. In this respect, it was seen for example that the connection of cellular frames 125 reflecting the edge-to-edge orientation of twenty Case 3 pyramids resulted in the exterior geometrical structure as shown in FIG. 6A and the interior geometrical structure shown in FIG. 6B. When cellular frames 125' are connected in like manner, however, the geometrical structure of FIG. 6A becomes the interior structure and the geometrical structure of FIG. 6B becomes the exterior structure. It is thus understood that a similar inversion of interior-exterior geometrical structures can occur by use of cellular frame 125' with respect to the face-to-face or edge-to-edge orientation of a plurality of pyramid-like tetrahedrals frames of the above-cited and other cases. Similarly, as shown hereinafter with reference to FIG. 15, a connection of cellular frames 125 may be expanded toward or away from center 90 by alternating exterior and interior formations.

DOUBLE WEDGE-TYPE TETRAHEDRON REPRESENTATION

The imaginary solid geometric double wedge-type illustrated in FIG. 3B has imaginary planar faces 200 (front side face), 202 (top face), 204 (bottom face), and 206 (back side face). Faces 200 and 206 meet to form a dihedral angle at edge 208; faces 200 and 204 meet to form a dihedral angle at edge 210; faces 200 and 202 meet to form a dihedral angle at edge 212; faces 202 and 204 meet to form a dihedral angle at edge 214; faces 204 and 206 meet to form a dihedral angle at edge 216; and, faces 202 and 206 meet to form a dihedral angle at edge 218.

The imaginary solid geometric double wedge-type tetrahedron 72 is represented in FIG. 3B by a cellular frame of connected together-struts (such as struts 46 or 46'). In generating the cellular frame, the struts are used to represent each imaginary planar face 200, 202, 204, and 206. In this respect, struts 220, 221, and 22 represent imaginary planar face 200 and have their first ends connected together at interior point 223. Struts 224, 226, and 228 represent the planar face 204 and have first ends thereof connected together at interior point 229. Struts 230, 232, and 234 represent face 202 and have their first ends connected together at interior point 235. Struts 236, 238, and 240 represent face 206 and have their first ends connected together at interior point 242. The second ends of struts 221 and 240 are connected at a vertex 244 which lies along imaginary edge 208; struts 222 and 228 have their second ends connected together at vertex 246 which lies along imaginary edge 210; struts 220 and 234 have their second ends connected together at a vertex 250 which lies along imaginary edge 212; struts 226 and 232 have their seconds ends connected together at a vertex 252 which lies along imaginary edge 214; struts 224 and 238 have their second ends connected together at a vertex 254 which lies along imaginary edge 216; and, struts 230 and 236 have their second ends connected together at a vertex 256 which lies along imaginary edge 218.

Thus, it is seen that the first end of each strut representing a planar face of the tetrahedron 72 has a first end thereof connected at an interior point of the plane to first ends of other struts representing the planar face, and a second end positioned to terminate at a point which lies at an intermediate location along a corresponding imaginary edge of the tetrahedron 72. The struts are perpendicular to imaginary edges, thus forming dihedral angles of intersecting imaginary faces. Moreover, the struts are connected in the just-described manner to form a cellular frame 260 which represents or corresponds to an imaginary solid geometric double wedge-type tetrahedron 72 which the cellular frame 260 is said to represent.

It will be appreciated that a represented imaginary solid geometrical double wedge-type tetrahedron such as tetrahedron 72 has characteristics (such as the magnitude of the dihedral angles) which depend upon factors such as the length of the various struts utilized in the generation of the cellular frame. Numerous double wedge-type tetrahedrons can accordingly be generated. Four examples are provided below and are referenced herein as Double Wedge Case 1; Double Wedge Case 2; Double Wedge Case 3; and, Double Wedge Case 4.

According to Double Wedge Case 1, the represented tetrahedron is isosceles with the dihedral angle formed at edge 208 or vertex 244 being on the order of 120 degrees. FIGS. 8A and 8B show three imaginary Case 1 Double Wedges connected in a manner to share edge 208 and vertex 244 as a major axis 269 and with their representing cellular frames forming a cluster 270. Exterior struts included in the cluster 270 represent a polyhedron having six triangular faces.

According to Double Wedge Case 2, the represented tetrahedron is isosceles with the dihedral angle formed at edge 208 or vertex 244 being on the order of 90 degrees. FIGS. 9A and 9B show four imaginary Case 2 Double Wedges connected in a manner to share edge 208 as a major axis 271 and with their representing cellular frames forming a cluster 272. As shown in FIG. 9A the perimeter of the thusly-connected Case 2 Double Wedges comprising the cluster 272 is a square. The exterior struts included in the cluster 272 represent a polyhedron having eight triangular faces.

According to Double Wedge Case 3, the represented tetrahedron is isosceles with the dihedral angle formed at edge 208 or vertex 244 being on the order of 72 degrees. FIGS. 10A and 10B show five imaginary Case 3 Double Wedges connected in a manner to share edge 208 as a major axis 273 and with their representing cellular frame forming a cluster 274. The exterior struts included in the cluster 274 represent a polyhedron having ten triangular faces.

According to Double Wedge Case 4, the represented tetrahedron is isosceles with the dihedral angle formed at edge 208 or vertex 244 being on the order of 60 degrees. FIGS. 11A and 11B show six imaginary Case 4 Double Wedges connected in a manner to share edge 208 as a major axis 275 and with their representing cellular frames forming a cluster 276. The exterior struts included in the cluster 276 represent a polyhedron having twelve triangular faces.

From the foregoing it is recognizable that a plurality of frames representing a plurality of imaginary Double Wedges can be generated and oriented about a common vertex which will lie on a major axis of a cluster. The cellular frames representing each Double Wedge are formed so that the dihedral angles at edges 208 are identical in magnitude with the magnitude of the dihedral angle being chosen in accordance with the number of Double Wedges to be represented. In this respect, the cellular frames are formed to have a dihedral angle at edge 208 on the order of 360÷N degrees where N is the number of cellular frames to be included in the cluster.

With respect to the cellular frames comprising the clusters 270, 272, 274, and 276, it is understood that struts comprising a cellular frame representing a first double wedge of a cluster have reference numerals suffixed with the letter "A", that struts comprising a cellular frame representing a second double wedge of the same cluster have reference numerals suffixed with the letter "B", and so forth. Accordingly, the cluster 270 comprises three cellular frames having struts with reference numerals suffixed by the letters "A", "B" and "C". The cluster 272 comprises four cellular frames, having struts with reference numerals suffixed by the letters "A", "B", "C", and "D", respectively. Thus it is understood that a strut comprising cluster 270 and indicated by a particular reference numeral (such as 230A, for example) is not the same strut as indicated by an identical reference numeral for another cluster (such as cluster 272).

The cellular frames comprising each cluster share a common vertex, particularly the vertex which lies along the edge 208 (and hence the major axis of the cluster). For example, with respect to the solid geometric general Double Wedge shown in FIG. 3B, the three cellular frames comprising the cluster are formed in a manner whereby vertex 244 of one of the three cellular fames becomes a common vertex for all three cellular frames.

Clusters can be substituted for the faces of imaginary solid geometric polyhedrons and connected together when oriented in accordance with the substitution. Each cluster replaces the corresponding face of the imaginary polyhedron in a manner whereby the major axis of the cluster is orthogonal to the plane of the faces. Depending upon the characteristics (particularly the magnitude of the dihedral angle formed by such struts as struts 226 and 232) of the particular Double Wedge represented by the strut frames comprising the cluster, the struts from a plurality of cellular frames may represent a regular interior polyhedral structure whose center is located at the center of the imaginary polyhedron. In such situations certain struts from adjacent cellular frames represent coincident tetrahedron planar faces, meaning that no spaces or gaps exist between the planar tetrahedral faces (and hence those certain struts are essentially coincident). As seen hereinafter, in certain other situations wherein struts from a plurality of cellular frames do not represent a complete such interior polyhedral structure (i.e. in situations in which gaps or spaces exist between represented planar spaces), supplemental struts or bridging struts can be added in the spaces or gaps to complete the interior geometrical structure.

Figure 12A:
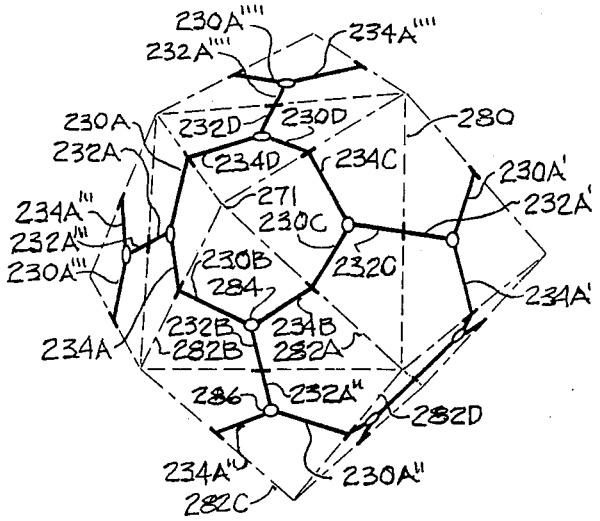
FIG. 12A is a front perspective view of various struts included in cellular frames representing Case 2 Double Wedges constructed and connected together in a manner whereby each face of an imaginary solid geometric cube is replaced by a cluster of cellular frames.

In the above regard, FIG. 12A is a front perspective view showing various exterior struts when each face of a solid geometry cube is replaced by the cluster 272 illustrated in FIGS. 9A and 9B. A first face of the cube shown by broken lines 280 is replaced by cluster 272; a second face of the cube is replaced by a cluster identical to cluster 272 but having struts bearing primed reference numerals; a third face of the cube is replaced by a cluster which is identical to cluster 272 but which has struts bearing double primed reference numerals; and so forth.

The exterior geometrical structure represented by struts shown in FIG. 12A is a rhomboid-faced dodecahedron. Each face of the dodecahedron is represented by a set of struts with each of the struts in a set being coplanar. For example, one face (shown by broken lines 282A, 282B, 282C, and 282D) of the dodecahedron of FIG. 12A is represented by a set of struts consisting of struts 230B, 232B, 234B, 230A'', 232A'', and 234A''. Major axis 271 of cluster 272 is orthogonal to the plane of the cubic face bounded by broken lines 280. The rhomboid face is represented by the just-listed struts in view of the fact that struts 230B, 232B, and 234B have ends connected together at an interior point (point 284) of the planar face; that struts 230A'', 232A'', and 234A'' have ends connected together at an interior point (point 286) of the planar face; and, that the struts whose second ends are not connected to a coplanar strut have their second ends positioned to terminate at and bisect the respective perimeter sides of the rhomboid face. In this regard, the second end of strut 230B terminates at and bisects side 282B; the second end of strut 234A'' terminates at and bisects side 282C; the second end of strut 230A'' terminates at and bisects side 282D; and, the second end of strut 234B terminates at and bisects side 282A.

Figure 12B:
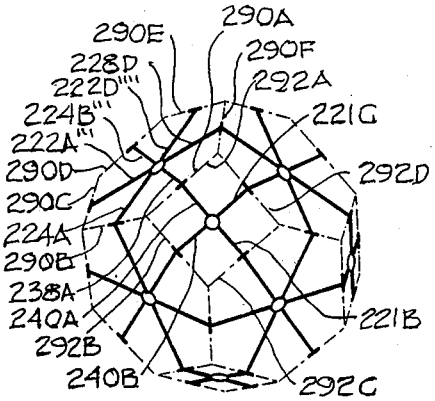
FIG. 12B is a front perspective view of various other struts included in cellular frames representing Case 2 Double Wedges constructed and connected together in a manner whereby each face of an imaginary solid geometric cube is replaced by a cluster of cellular frames.

FIG. 12B is a front perspective view showing various interior struts when each face of solid geometric cube is replaced by the cluster 272 in the manner described above. The interior geometrical structure represent a polyhedron having hexagonal and square faces. For example, a set of struts consisting of struts 228D, 238A, 224A, 222A''', 224B''', and 222D'''' represent an imaginary solid geometric hexagon (shown by broken lines 290A, 290B, 290C, 290D, 290E, and 290F). In addition, a set of struts consisting of struts 240A, 240B, 221B, and 221C represent an imaginary solid geomtric square (shown by broken lines 292A, 292B, 292C, and 292D).

In the particular structure which results when each face of an imaginary cube is replaced with a cluster 272 in the above-described manner, certain struts from a plurality of cellular frames represent a regular interior polyhedral structure (as described above) whose center is located at the center of the imaginary cube. Only in some cases will interior struts from a plurality of cellular frames represent such a complete interior polyhedral structure. In cases in which a complete interior polyhedral structure is not so formed, spaces or gaps occur between the planar tetrahedron faces represented by such interior struts.

Figure 13A:
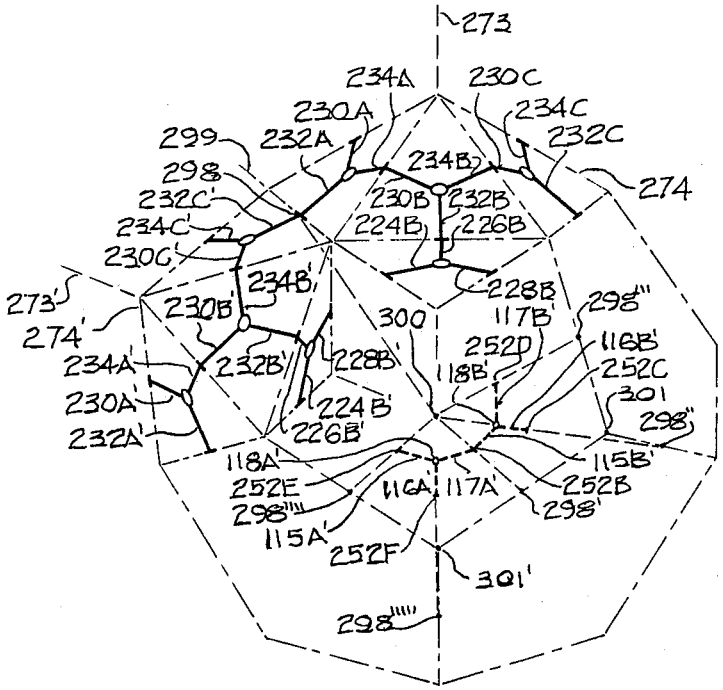
FIG. 13A is a front perspective view of various struts included in cellular frames representing Case 3 Double Wedges constructed and connected together in a manner whereby each face of an imaginary solid geometric pentagonal-faced dodecahedron is replaced by a cluster of cellular frames, and wherein various struts from the cellular frames represent a regular interior polyhedral whose center is at the center of the imaginary dodecahedron.

FIG. 13A shows clusters of the type of Double Wedge Case 3 illustrated in FIGS. 10A and 10B replacing the faces of an imaginary pentagonal-faced dodecahedron. When the dihedral angle formed by struts 232 and 226 for each cellular frame comprising the cluster is 120 degrees, then various interior struts from interior adjacent cellular frames represent planar tetrahedron faces that are coplanar (coincident) with one another so that no spaces or gaps exist therebetween. When as in FIGS. 13B(1) and 13B(2) the dihedral angle formed by struts 232 and 226 is less than 120 degrees, struts form adjacent cellular frames represent planar tetrahedron faces which are not coplanar (i.e. spaces or gaps exist between the represented tetrahedron faces).

In the cases wherein interior struts of adjacent cellular frames represent planar tetrahedron faces which are not coplanar, supplemental or bridging struts can be added to complete an interior geometrical structure. In FIGS. 13B(1) and 13B(2) the space to be bridged between clusters 274 and 274' is the gap between the two tetrahedron faces implied by struts 226A, 224A, and 228A of cluster 274 and struts 226C', 224C', and 228C' of cluster 274'. When related to the double wedge tetrahedron of FIG. 3B, the above imaginary faces correspond to faces 200 and 206. The space is bridged by completing the faces 202 and 204 in FIG. 3B. Struts 292, 294, and 296 in FIGS. 13C, 13D, and 13E, and struts 291, 293, and 295 in FIG. 13E complete the tetrahedral bridge frame. Struts 296 and 295 correspond to struts 232 and 226 of FIG. 3B, and intersect at 252A, just as struts 232 and 226 intersect at 252 in FIG. 3B.

In FIG. 13A, the center of the polyhedral is indicated at point 300. A line projecting from center 300 to connection 298 passes through 252A, the lower dihedral connection of the bridge frame in FIGS. 13C and 13D. The lower portion of FIG. 13A indicates comparable points to connection 298 as 298', 298'', 298''', 298'''', and 298'''''. These lie in the center of other pentagon edges. Lines projecting from the center 300 to these connections pass through 252B, 252C, 252D, 252E, and 252F, the lower dihedral connections of the bridge frames as in FIGS. 13C and 13D. As bridge frames are completed in the above-described manner their lower dihedral connections form a series of equilateral triangular arrangements, the centers of which fall on a line connecting center 300 to 301 and 301', the points where three pentagonal faces intersect. Since there are twenty 301 intersections per dodecahedron, twenty equilateral triangular arrangements or imaginary faces result as the completed center structure. FIG. 4A illustrates the completed center structure. As shown in FIG. 13A, two imaginary faces are represented by struts 115A', 116A', and 117A', and 115B', 116B', and 117B'.

Figure 13F:
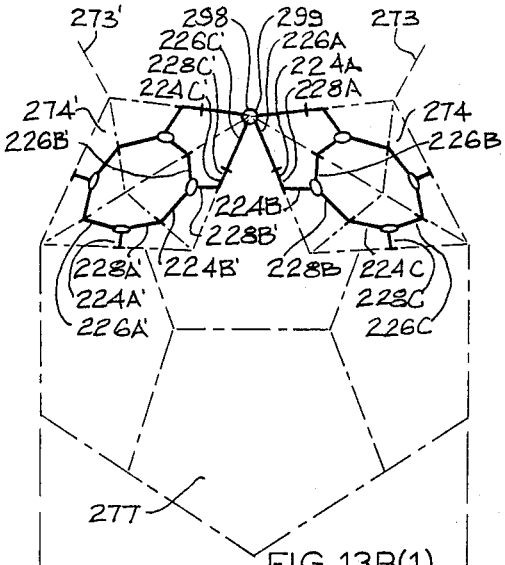
FIG. 13F is a front view of an imaginary polyhedron formed when twelve pentagonal clusters replace the twelve faces of a dodecahedron.
Figure 13F:
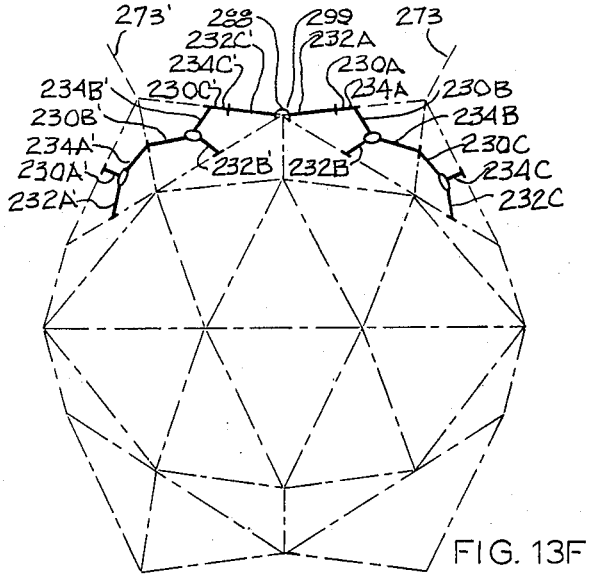
Figure 13E:
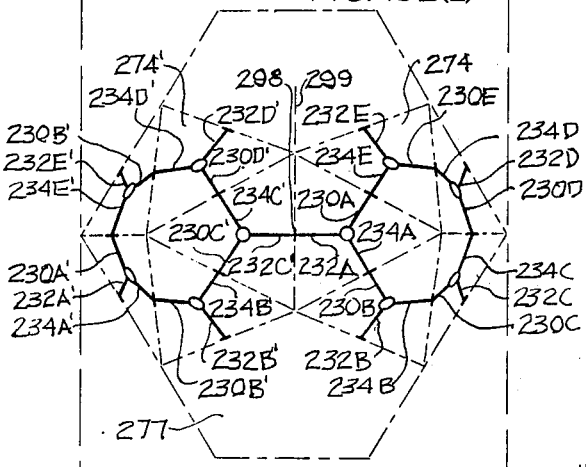
FIGS. 13D and 13E are front and plan views, respectively, of the various struts shown in FIG. 13C together with other struts included in an orthogonal cluster.
Figure 13E:
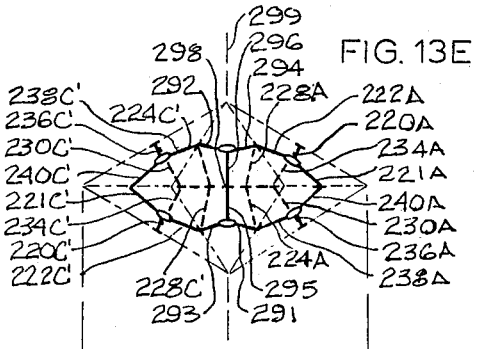
Figure 13C:
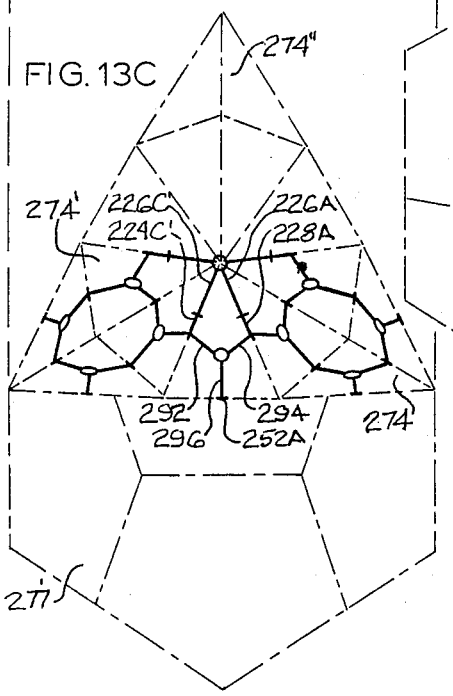
FIG. 13C is a front view of various struts included in cellular frames representing Case 3 double wedges constructed and connected together in a manner whereby each face of an imaginary solid geometric pentagonal-faced dodecahedron is replaced by a cluster of cellular frames, together with bridging struts added to partially complete an interior geometrical structure.
Figure 13D:
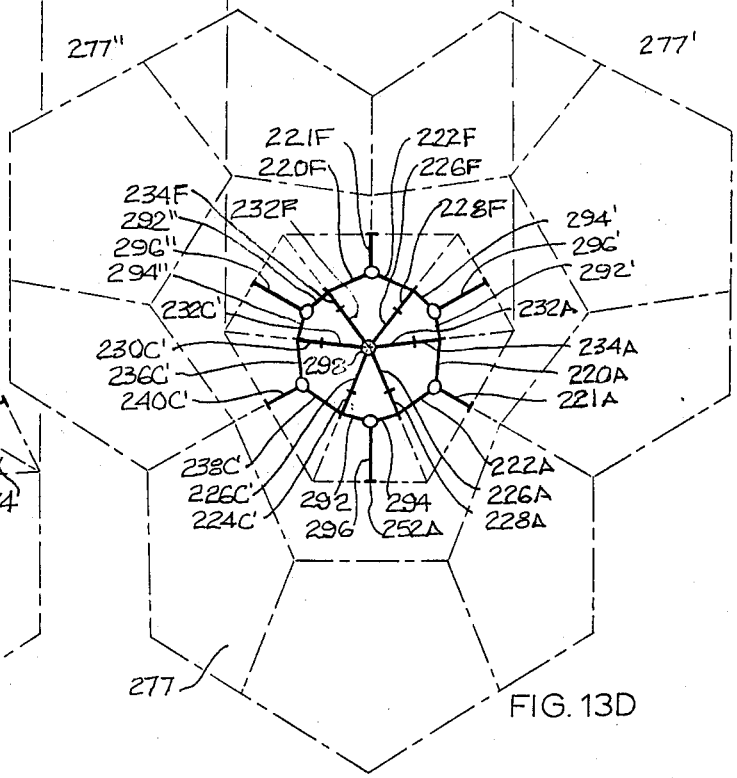

FIG. 13C also shows the broken line addition of cluster 274'', which pairs with cluster 274 to begin a new adjacent polyhedral formation 277' in FIG. 13D. Cluster 274'' also pairs with 274' to begin a new adjacent polyhedral formation 277''.

From FIGS. 13A, 13B(1), 13B(2), and 13F, it is seen that major axis 273 of cluster 274 is orthogonal to the plane of the pentagon face which cluster 274 replaces, and likewise that major axis 273' of cluster 274' is orthogonal to the plane of the pentagon face which cluster 274' replaces. Moreover, it is understood by analogy to FIGS. 10A and 10B that strut 232A is connected to strut 226A at vertex 298 which lies along the corresponding side 299 of the represented pentagon perimeter of the cluster 274. Further, with reference to edges 208 and 214 of FIG. 3B, it is understood that perimeter side 299 is orthogonal to the major axis 273. This being the case, perimeter side 299 now serves as a second imaginary axis about which a cluster known as an orthogonal cluster can be generated.

In the above regard, it will be recognized that struts 232A and 226A (of the cellular frame depicted by struts having "A"-suffixed, uprimed reference numerals) form a dihedral angle about imaginary axis 299 and that struts 232C' and 226C' (of the cellular frame depicted by struts having "C"-suffixed, primed reference numerals) also form a dihedral angle about axis 299. A plurality of other cellular frames, a particularly a total of six such cellular frames, can be formed about axis 299 as shown in FIG. 13D. The major axis (i.e. axis 299) of this new cluster is perpendicular to the axes 273,273' of the clusters 274,274' and therefore the new cluster is denominated an "orthogonal" cluster. The number of cellular frames formed about axis 299 for inclusion in the orthogonal cluster is dependent upon the magnitude of the dihedral angles formed by struts such as struts 232A and 226A at axis 299.

FIGS. 13D and 13E are plan and elevation views of an orthogonal cluster. Tetrahedral frames A, C', and F from clusters 274, 274', and 274'', together with three bridge tetrahedral frames form the orthogonal cluster. The dihedral angles of A, C', and F at center 298 are 72°. The dihedral angles of the bridge tetrahedral frames at center 298 are 48°. When the dihedral angle formed by struts 232 and 226 of FIG. 10B is 120°, the resulting orthogonal cluster resembles FIG. 8A. When the same dihedral angle is 60°, the resulting orthogonal cluster resemble FIG. 11A.

FIGS. 12A and 12B illustrated how the faces of an imaginary solid geometric cube can be replaced by cluster 272. FIGS. 13A and 13B illustrated how the faces of an imaginary solid geometric pentagonal-faced dodecahedron can be replaced by a cluster such as cluster 274. With refrence to FIG. 15C (which shows a polyhedron with both pentagonal and hexagonal-shaped faces), it is understood that a first type cluster (such as a Case 3 Cluster) can replace one type face of a polyhedral while a second type cluster (such as a Case 4 Cluster) can replace a second type face of the polyhedral.

EQUILATERAL-TYPE TETRAHEDRON REPRESENTATION

The imaginary solid geometric equilateral-type tetrahedron 74 illustrated in FIG. 3C has imaginary planar faces 302 (front right face), 304 (front left face), 306 (back upper face), and 308 (back lower face). Faces 302 and 304 meet to form a dihedral angle at edge 310; faces 302 and 308 meet to form a dihedral angle at edge 312; faces 302 and 306 meet to form a dihedral angle at edge 314; faces 304 and 306 meet to form a dihedral angle at edge 316; faces 306 and 308 meet to form a dihedral angle at edge 318; and, faces 304 and 308 meet to form a dihedral angle at edge 320. For the equilateral-type tetrahedron 74, the dihedral angles just mentioned are all equal in magnitude and all face angles (such as angle 322) are equal to 60 degrees.

The imaginary solid geometric equilateral-type tetrahedron 74 is represented in FIG. 3C by a cellular frame 324 of connected-together struts (such as struts 46 or stuts 46'). In generating the cellular frame, the struts are used to represent each imaginary planar face 302, 304, 306, and 308. In this respect, struts 330, 332, and 334 represent imaginary planar face 302. Struts 330, 332, and 334 each have their first ends connected together at an interior point 336 of the planar face 302. The manner of the connection is understood, for example, with reference to similarly connected-together struts 46A, 46B, and 46C along axis 58 as shown in FIG. 2. The second or opposite ends of the struts 330, 332, and 334 are positioned to define intermediate points along the respective edges 314, 312, and 310 of the imaginary solid geometric equilateral tetrahedron. In this regard the second end of strut 330 terminates at a point 338 which lies at an intermediate location along imaginary edge 314; the second end of strut 332 terminates at a point 340 which lies at an intermediate location along imaginary edge 312; and, the second end of strut 334 terminates at a point 342 which lies at an intermediate location along imaginary edge 310.

The other imaginary planar faces 304, 306, and 308 are represented in similar manner. In this respect, FIG. 3C shows struts 350, 352, and 354 with first ends thereof connected together at point 356 to represent face 304; struts 358, 360, and 362 with first ends thereof connected together at point 364 to represent face 306; and, struts 368, 370, and 372 with first ends thereof connected together at point 374 to represent face 308.

The second ends of the struts used to represent an imaginary planar face are positioned not only to form an imaginary edge of the imaginary tetrahedron, but also to be connectable at the imaginary edge to a second end of a strut representing a neighboring face, thereby forming a vertex of the cellular frame. For example, the second end of strut 330 connects to the second end of strut 358 at vertex 338 lying on imaginary edge 314. In like manner, struts 332 and 368 connect at vertex 340; struts 350 and 360 connect at vertex 380; struts 362 and 372 connect at vertex 382; struts 352 and 370 connect at vertex 384; and, struts 334 and 354 connect at vertex 342.

In the above-described manner the struts 330, 332, 334, 350, 352, 354, 358, 360, 362, 368, 370, and 372 are connected together to form a cellular frame 324 which represents or corresponds to an imaginary solid geometric equilateral-type tetrahedron 74 which the cellular frame 324 is said to represent.

It will now be seen that a plurality of cellular frames 324 can be generated and connected to one another in a manner to generate geometrical structures. In the ensuing discussion, it will be understood that a first cellular frame (generated in the above-described manner) is depicted by struts having the reference numerals suffixed with the letter "A"; a second similarly-generated cellular frame is depicted by struts having reference numerals suffixed by the letter "B"; a third similarly-generated cellular frame is dèpicted by struts having reference numerals suffixed by the letter "C"; and so forth.

In the above regard, FIG. 14A(1) shows how four cellular frames 324A, 324B, 324C, and 324D are connected together (edge to edge). If four additional cellular frames 324J, 324K, 324L, and 324M were connected edge to edge at 342A, 342B, 342C, and 342D of the four already-connected frames, the triangularly-faced octahedron interior geometrical structure of FIG. 14A(2) results. One face of the octahedral is represented by struts 330A, 332A, and 334A; a second face of the octahedron is represented by struts 330B, 332B, and 334B; a third face of the octahedron is represented by struts 330C, 332C, and 334C; and a fourth face of the octahedron is represented by struts 330D, 332D, and 334D. The four additional octahedron faces resulting from the edge to edge connection of frames 324J, 324K, 324L, and 324M are represented by struts 330J, 332J and 334J; 330K, 332K, and 334K; 330L, 332L, and 334L; 330M, 332M, and 334M.

Figure 14B:
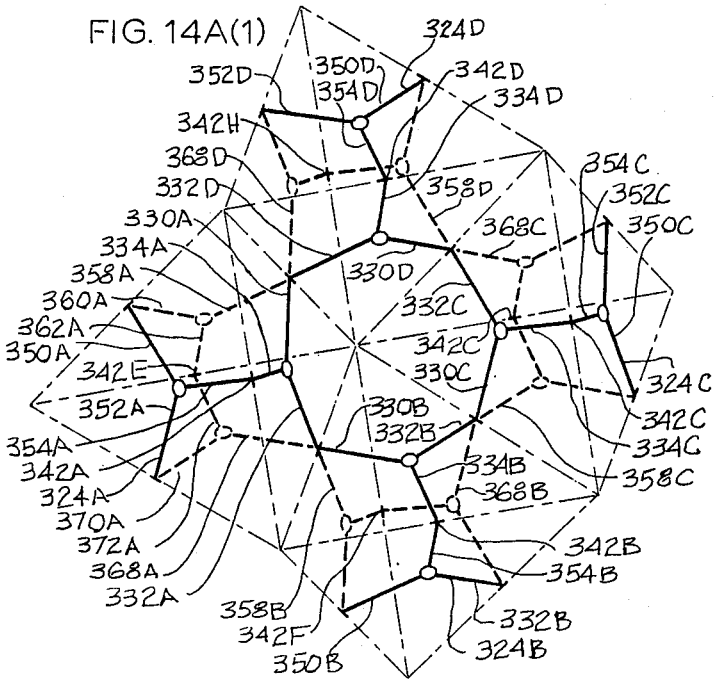
FIG. 14B is a perspective view showing struts representing a solid geometry rhomboid-faced dodecahedron, the illustrated struts including struts included in four additional cellular frames connected edge-to-edge in a second manner to the tetrahedron represented by the cellular frames shown in FIG. 14A(1)
Figure 14B:
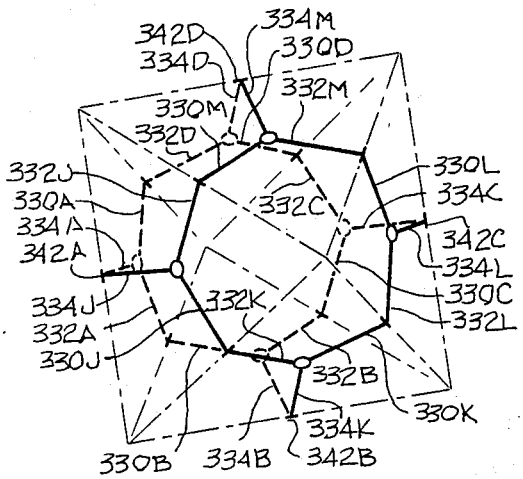

FIG. 14B shows other struts which form an interior geomtrical structure when four additional cellular frames 324E, 324F, 324G, and 324H are connected edge to edge at 342E, 342F, 342G, and 342H of the four cellular frames 324A, 324B, 324C, and 324D shown connected in FIG. 14A(1). The interior structure represented by the struts shown in FIG. 14B is a rhomboid-faced dodecahedron. For example, struts 330A, 358A, 368D, and 332D represent one rhomboid face. Moreover, a series of four interconnected hexagonal meridians are also formed. For example, a first such meridian includes struts 368C, 330D, 332D, 358A, 362A, and 362E.

USING REPRESENTED STRUCTURES

It has been shown above how three types of imaginary solid geometric tetrahedrons—pyramid-type tetrahedrons; double wedge-type tetrahedrons; and, equilateral-type tetrahedrons—are representable by cellular frames. It has further been shown with respect to each type of tetrahedron how a plurality of cellular frames representing the tetrahedrons can be oriented and connected together in various manners to represent geometrical structures.

Cellular frames that represent double wedgetype tetrahedrons can be connected together to form clusters. Clusters can be used to replace faces of imaginary solid geometric polyhedrons, resulting in the representation of a new polyhedron. For example, FIG. 13F shows an exterior geometrical structure representing a triangularly-faced 60 faced polyhderon (five faces per pentagonal cluster exposed) which results when clusters replace the planar faces of a pentagonal-faced dodecahedron.

Cellular frames that represent either pyramid-type tetrahedrons or equilateral-type tetrahedrons can be oriented and connected together in either edge to edge relationship or face-to-face relationship in a manner whereby a first set of struts are co-planar and represent a polygon of a first type, and possibly in a manner whereby a second set of struts are coplanar and represent a polygon of a second type. In some cases the polygon represented by the first set of struts is a face of a multi-faced polyhedron which is represented by an exterior geometrical structure, and the polygon represented by the second set of struts is a face of another multi-faced polyhedron which is represented by an interior geometrical structure. For example, with respect to the same grouping of cellular frames, FIG. 4A shows an exterior geometrical structure which represents a triangularly-faced icosahedron formed by a plurality of first sets of struts while FIG. 4B shows an interior geometrical structure which represents a pentagonal-faced dodecahedron.

Figure 12C:
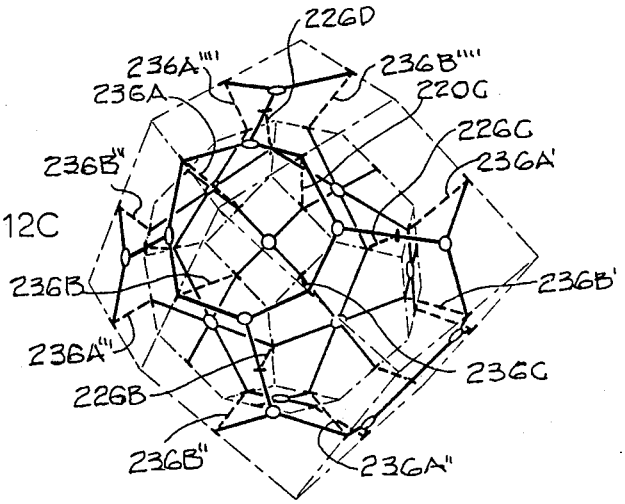
FIG. 12C is a front perspective view of connected-together cellular frames with a strut removed in order to provide a greater unobstructed volume between the exterior geometrical structure of FIG. 12A and the interior geometrical structure of FIG. 12B.

Once a plurality of cellular frames forming a geometrical structure, such as exterior or interior geometrical structure, has been constructed in accordance with the foregoing, various struts can be added or deleted. For example, in order to provide a greater unobstructed spatial volume, one or more struts connecting an exterior geometrical structure and an interior geometrical structure can be removed. FIG. 12C illustrates the removal of such struts (shown in short dotted lines) from between an exterior geometrical structure which represents a rhomboid-faced dodecahedron (also seen in FIG. 12A) and an interior geometrical structure (also seen in FIG. 12B). In view of the fact that neighboring struts can be bridged by hard or flexible sheet material which serves as a wall, it is seen how compartments of differing sizes can be created and easily modified.

Figure 16:
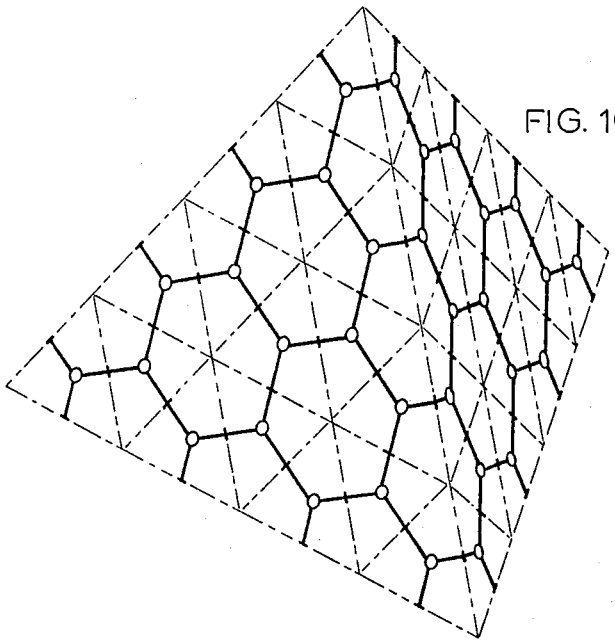
FIG. 16 is a perspective view of an exterior geometrical structure formed by the edge to edge connection of a plurality of equilateral tetrahedron representing cellular frames about a core equilateral tetrahedron-representing cellular frame; and, FIG. 17 is a perspective view of an exterior geometrical structure formed by the edge to edge connection of a plurality of eight equilateral tetrahedron-representing cellular frames about a core which is the geomtrical structure of FIG. 14B.
Figure 17:
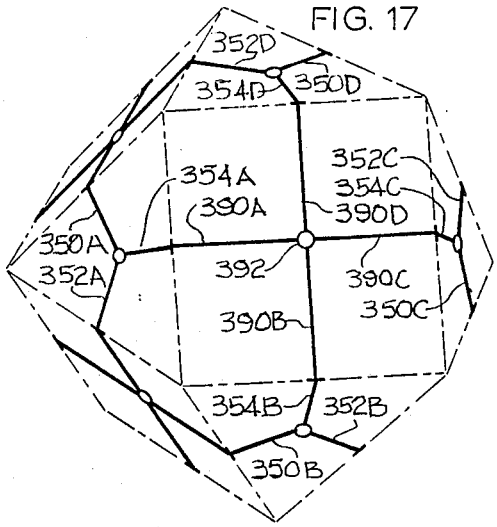

Additional cellular frames can be added to build outwardly from the center of an existing exterior geometrical structure. With reference to a cellular frame which represents an equilateral-type tetrahedron, if the frame 324A of FIG. 14A(1) is used as a core and other cellular frames are connected therearound in a manner whereby the represented tetrahedral frames are oriented edge to edge, the exterior structure of FIG. 16 results. If the octahedron represented by cellular frames 324A, 324B, 324C, 324D, 324J, 324K, 324L, and 324M of FIG. 14A(2) is used as a core and other cellular frames are connected therearound in a manner whereby the represented tetrahedral cells are oriented edge to edge, the exterior structure (unillustrated) will also be an octahedron. If the exterior structure of FIG. 14B is used as a core and other cellular frames are connected therearound in a manner whereby the tetrahedral cells are oriented edge to edge, the exterior structure shown in FIG. 17 results. Supplemental connective struts such as struts 390A, 390B, 390C, and 390D with seconds ends meeting at an interior point 392 have been added in FIG. 17, it being understood that struts 390A, 390B, 390C, 390D are planar and represent a square face. Thus, FIG. 17 shows a truncated cubic exterior structure wherein various struts represent triangular faces while the supplementary connective struts represent square faces.

Figure 15:
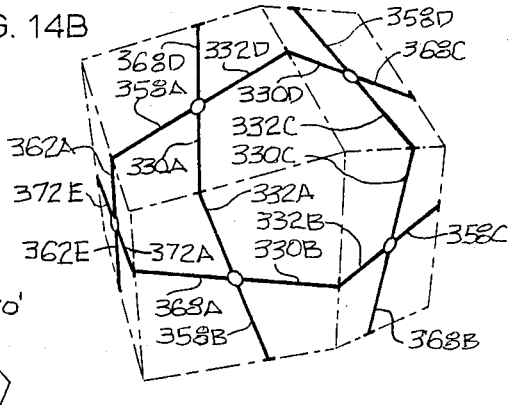
FIG. 15 is a perspective view of an expansion of the pyramid tetrahedral frame of FIG. 3A.

In some cases in which an interior geometrical structure also exists the construction of additional cellular frames around an existing geometrical structure results in a new exterior geometrical structure which resembles the interior geometrical structure. Such occurs, for example, with reference to the exterior and interior geometrical structures of FIGS. 4A and 4B. The construction of further cellular frames about the exterior geometrical structure of FIG. 4A results in a new exterior geometrical structure which resembles the interior geometrical structure of FIG. 4B. The construction of even further cellular frames about the new exterior geometrical structure resembling FIG. 4B will result in yet another exterior geomtrical structure which resembles the structure of FIG. 4A. Thus, it is seen that certain structures can be repetitive when used as a core of further structures. FIG. 15 illustrates this principle on the basis of a pyramid tetrahedral frame.

Figure 15A:
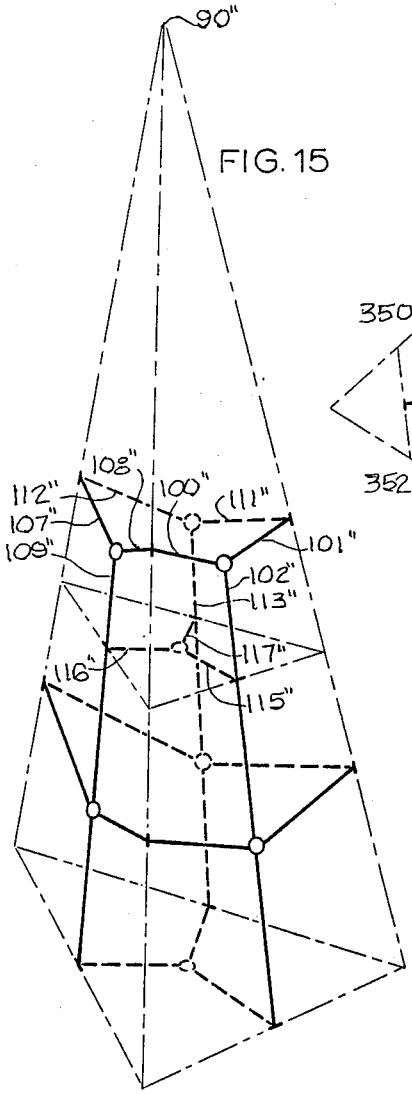
FIG. 15A is a perspective view of a truncated equilateral tetrahedral frame formed by adding struts to the equilateral tetrahedral frame of FIG. 3C.
Figure 15A:
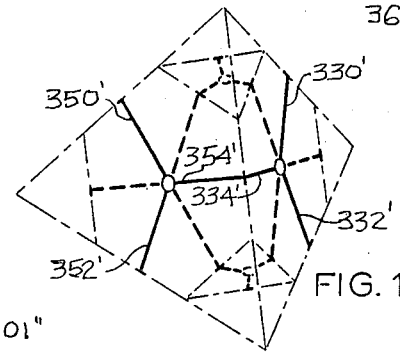
Figure 15B:
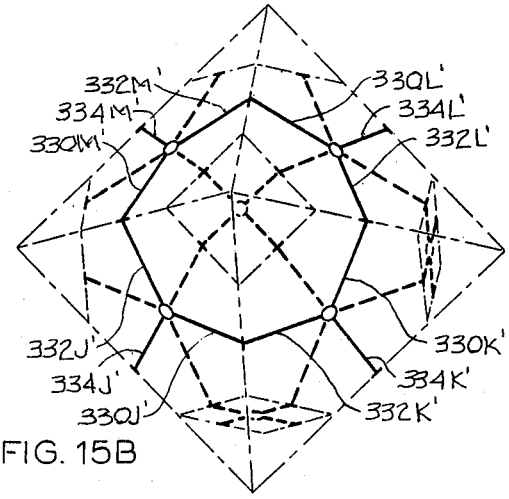
FIG. 15B is a perspective view of a truncated octahedral frame formed by adding struts to the octahedral frame of FIG. 5A.
Figure 15C:
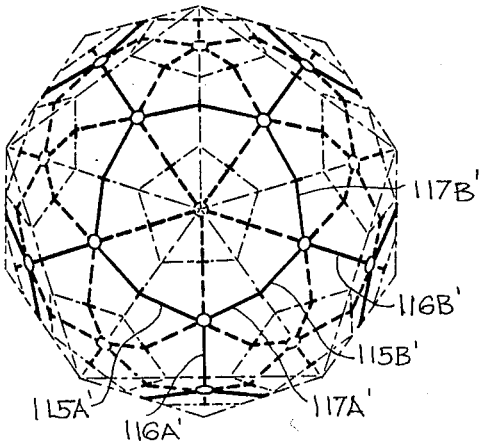
FIG. 15C is a front view of a truncated icosahedral frame formed by adding struts to the icosahedral frame of FIG. 4A.
Figure 15D:
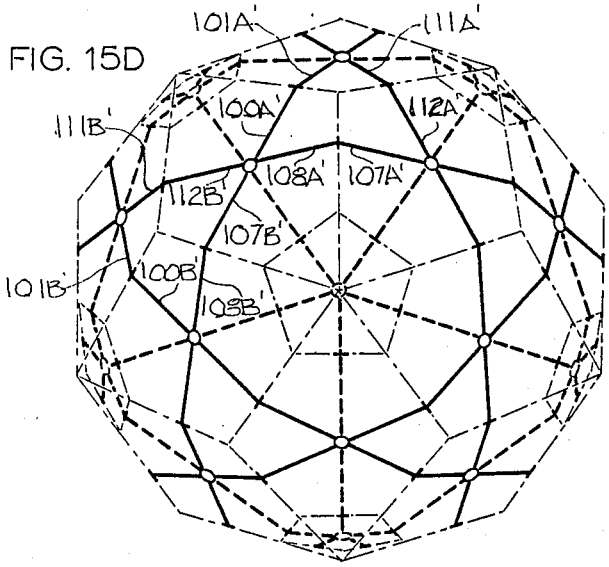
FIG. 15D is a front view of the structure formed by adding struts to the frame of FIG. 6B.

Within the confines of their imaginary solid geometry volumes, basic cellular frames may be changed by merely adding struts to the basic frame. FIG. 15A is a truncated equilateral tetrahedral frame formed by adding struts to the frame in FIG. 3C. The broken lines are added struts, which result in hexagonal and triangular imaginary faces. FIG. 15B is a truncated octahedral frame formed by adding struts to the frame in FIG. 5A, but at a different view. The broken lines are added struts, resulting in hexagonal and square imaginary faces, or the same structure as in FIG. 12B. FIG. 15C is a truncated icosahedral frame formed by adding struts to the frame in FIG. 4A. The broken lines are added struts, resulting in hexagonal and pentagonal imaginary faces. FIG. 15D results by adding struts to the frame in FIG. 6B. The broken lines are added struts, resulting in irregular hexagonal and regular pentagonal imaginary faces. Where any basic frames occur in the various construction combinations of this system, struts may be added as above, or where the frames resulting from added struts occur in this system, struts may be omitted accordingly.

Many geomtrical structures constructed in accordance with the invention can be combined with essentially identical geometrical structures to form a compound geometrical structure. For example, a central geometrical structure can serve as a center of a compound structure when essentially identical geomtric structures are constructed in a manner to share corresponding responding faces of the central geometrical structure. For example, the exterior geometrical structure of FIG. 6A can serve as a central or core structure about which twelve essentially identical structures can be constructed. In this respect, each of the twelve further structures would be constructed to share struts which represent one of the twelve pentagonal faces of the core structure. Construction of the thirteen geometrical structures which comprise the resulting compound structure also results in the generation of a plurality of cellular frames which represent equilateral tetrahedrons. In such construction, the cellular frames representing newly-generated equilateral tetrahedrons include struts which, as seen in FIG. 6A, represent triangular faces (such as struts 115A, 116A, and 117A, for example). Similar compound structures can be generated about core structures that are dodecahedral and icosahedral.

The polyhedral structures produced by the steps of the invention provide modular frames which do not have awkward corners such as those which would otherwise occur at the non-planar intersection of three planar faces of the represented solid geometric polyhedrons. Modular construction of both permanent and temporary structures or craft is faciliated by the ability to add or delete struts or cellular frames in directions either toward or away from the center of the geometric structure. Rigid or flexible walls can be connected between struts to form cellular compartments. The ability to add and delete struts and/or cellular frames and the wall-forming material provides the ability to add or delete cellular compartments without affecting basic structural integrity. Accordingly, utilization of the method of the invention has application in the design, development, and construction of both earth-based structures (whether temporary, i.e. tents, etc., or permanent) and outer space structures (such as space stations). The connection of struts according to the invention also provides an instructional aid for the understanding of geometrical models, as well as a means of entertainment and recreation.

The embodiments of the invention in which an exclusive property or privilege is claimed are defined as follows:

1. A method of assembling a geometrical structure comprising the steps of:

(1) generating a first cellular frame of strut members to represent an imaginary solid geometric tetrahedron, said generation of said cellular frame comprising the substeps of:

(a) connecting together three struts to represent a first planar face of said imaginary tetrahedron, said three struts each having first ends thereof connected together at an interior point of said first planar face and second ends positioned to define intermediate vertex points along respective edges of said imaginary tetrahedron;

(b) repeating substep (a) for each of second, third, and fourth planar faces comprising said imaginary tetrahedron in a manner whereby second ends of said struts for each face are positioned to be connectable at corresponding vertex points to second ends of struts in neighboring faces, said vertex points being located at respective edges of said imaginary tetrahedron whereat dihedral angles are formed by neighboring planar faces; and, (c) connecting second ends of said struts for each face to second ends of struts in neighboring faces at corresponding vertex points to form the first cellular frame; and, (2) generating a plurality of further cellular frames whereby each cellular frame shares at least one vertex point with another cellular frame, said further cellular frames being generated in accordance with step (1).

2. The method of claim 1, wherein said first and said further cellular frames are connected together in a manner whereby a first set of struts are essentially co-planar and represent a polygon of a first type in said plane in which said first set of struts are essentially co-planar.

3. The method of claim 2, wherein said first set of struts represent said polygon of said first type by forming the perimeter of said polygon in said plane in which said first set of struts are essentially co-planar.

4. The method of claim 3, wherein a plurality of polygons of a first type are formed by struts included in said connected-together cellular frames.

5. The method of claim 2, wherein said first set of struts represent said polygon of said first type by being co-planar and by ends of a majority of the struts in said first set being bisectors of respective edges of said represented polygon.

6. The method of claim 5, wherein a plurality of polygons of a first type are represented by struts included in said connected-together cellular frames.

7. The method of claim 6, wherein said connected-together cellular frames represent a polyhedral having a plurality of faces in the form of said polygon of said first type.

8. The method of claim 2, wherein a second set of struts including struts in a plurality of neighboring ones of said cellular frames are essentially co-planar and represent a polygon of a second type.

9. The method of claim 8, wherein said second set of struts represent said polygon of said second type by forming the perimeter of said polygon in said plane in which said second set of struts are essentially co-planar.

10. The method of claim 8, wherein said second set of struts represent said polygon of said second type by being co-planar and by ends of a majority of the struts in said first set being bisectors of respective edges of said represented polygon.

11. The method of claim 1, wherein the imaginary tetrahedron represented by said first cellular frame is a pyramid having one equilateral face and three isosceles faces.

12. The method of claim 1, wherein the imaginary tetrahedron represented by said first cellular frame has four equilateral faces.

13. The method of claim 1, wherein said step of generating a plurality of further cellular frames includes the step of generating a further cellular frame that shares three vertices and three common struts with said first cellular frame, each of said three shared vertices being partially formed by one of said common three struts, said three struts representing a face of said imaginary tetrahedron.

14. The method of claim 1, wherein said step of generating a plurality of further cellular frames involves using at least one of said verticles of said first cellular frame of strut members as a common vertex for a plurality of further cellular frames in a manner whereby said first cellular frame together with said plurality of further cellular frames form a cluster of cellular frames having an imaginary major axis colinear with the edge of said imaginary tetrahedral of said first cellular frame on which said common vertex lies.

15. The method of claim 14, wherein said step of generating a plurality of further cellular frames includes the steps of:

generating each of said further cellular frames in a manner whereby the dihedral angles formed with respect to each cellular frame at said common vertex are equal.

16. The method of claim 15, further comprising the step of:

connecting a plurality of said clusters in a manner whereby a cluster replaces the face of an imaginary polyhedron with a major axis of each cluster being oriented orthogonally to the plane of the corresponding replaced face of said polyhedron.

17. The method of claim 16, wherein each face of said polyhedron is replaced with a cluster.

18. The method of claim 17, wherein struts included in said cellular frames represent an interior polyhedral structure which has a center at the center of said imaginary polyhedron.

19. The method of claim 16, wherein with respect to said imaginary polyhedron a vertex of each cluster is connected by supplemental struts to vertices of other clusters in a manner to represent a regular interior geometrical structure having a center at the center of said imaginary polyhedron.

20. The method of claim 5, further comprising the step of:

generating a cluster about a second imaginary axis, said second imaginary axis having a vertex of one of said cellular frames lying therein which vertex serves as the vertex of a dihedral angle which is orthogonal to the dihedral angle formed at said first imaginary major axis.

21. A geometrical structure assembled by the method of claim 1.

22. A method of assembling a geometrical structure comprising the steps of:

(1) generating a first cellular frame of strut members to represent an imaginary truncated solid geometric tetrahedron, said generation of said cellular frame comprising the substeps of:

(a) connecting together three struts to represent a truncated planar face of said truncated solid geometric tetrahedron, said truncated planar face being formed by the intersection of said geometric tetrahedron and a truncation plane, said three struts each having first ends thereof connected together at an interior point of said truncated planar face and second ends positioned to define intermediate vertex points along an edge of said truncated planar face;

(b) connecting together three further struts to represent a first planar face of said imaginary tetrahedron, said three further struts each having first ends thereof connected together at an interior point of said first planar face, two of said three further struts having second ends positioned to define intermediate vertex points along respective edges of said imaginary tetrahedron and a third of said three further struts having a second end thereof positioned to define an intermediate vertex point along an edge of said truncated planar face;

(c) repeating substep (b) for each of second and third planar faces comprising said imaginary tetrahedron in a manner whereby second ends of said struts for each face including said truncated face are positioned to be connectable at corresponding vertex points to second ends of said struts in neighboring faces and forming dihedral angles thereat; and, (d) connecting said second ends of said struts for each face including said truncated face to second ends of struts in neighboring faces at corresponding vertex points to form the first cellular frame; and, (2) generating a plurality of further cellular frames whereby each cellular frame shares at least one vertex point with another cellular frame, said further cellular frames being generated in accordance with step (1).

23. A geometrical structure assembled by the method of claim 22.

* * * * *